US010436021B2

(12) United States Patent
Ash et al.

(10) Patent No.: US 10,436,021 B2
(45) Date of Patent: Oct. 8, 2019

(54) COMMUNICATION METHODS AND APPARATUSES FOR DOWNHOLE LOGGING TOOLS

(71) Applicant: Reeves Wireline Technologies Limited, Leicestershire (GB)

(72) Inventors: Simon Christopher Ash, Nottinghamshire (GB); Edward Sheriff, Leicestershire (GB)

(73) Assignee: Reeves Wireline Technologies Limited (GB)

( * ) Notice: Subject to any disclaimer, the term of this patent is extended or adjusted under 35 U.S.C. 154(b) by 424 days.

(21) Appl. No.: 14/988,461

(22) Filed: Jan. 5, 2016

(65) Prior Publication Data

US 2016/0208596 A1 Jul. 21, 2016

(30) Foreign Application Priority Data

Jan. 8, 2015 (GB) ..... 1500274.4

(51) Int. Cl.
*E21B 47/12* (2012.01)

(52) U.S. Cl.
CPC ..... *E21B 47/12* (2013.01)

(58) Field of Classification Search
CPC ..... E21B 47/12
See application file for complete search history.

(56) References Cited

U.S. PATENT DOCUMENTS

| | | | | |
|---|---|---|---|---|
| 3,967,680 | A | 7/1976 | Jeter | |
| 4,763,258 | A | 8/1988 | Engelder | |
| 5,603,386 | A | 2/1997 | Webster | |
| 6,267,185 | B1 | 7/2001 | Mougel | |
| 6,315,062 | B1 * | 11/2001 | Alft | E21B 7/046 166/255.2 |
| 6,608,565 | B1 | 8/2003 | Van Steenwyk | |
| 6,948,572 | B2 | 9/2005 | Hay | |
| 7,222,681 | B2 | 5/2007 | Jones | |
| 7,245,229 | B2 | 7/2007 | Baron | |
| 7,298,285 | B2 | 11/2007 | Moriarty | |
| 8,866,632 | B2 | 10/2014 | Hrametz | |
| 2004/0056658 | A1 | 3/2004 | Masak | |

(Continued)

FOREIGN PATENT DOCUMENTS

| | | |
|---|---|---|
| EP | 2778722 A2 | 9/2014 |
| WO | 2009014720 | 1/2009 |

*Primary Examiner* — Kristyn A Hall

(74) *Attorney, Agent, or Firm* — Blank Rome, LLP

(57) ABSTRACT

Logging tool communication apparatus (10), for carrying out a downhole communication method, comprises rotatable and/or longitudinally reciprocable drill pipe (12) including fixed or capable of being fixed in a co-rotative and/or co-reciprocable relationship at an in-use downhole end an in-use downhole logging tool (27). The logging tool (27) includes a movement sensor (33); and the apparatus (10) includes a motor, at a location remote from the logging tool (27), for causing rotation and/or reciprocation of the drill pipe (12) in a borehole or wellbore (18). The apparatus (10) includes one or more control elements for selectively controlling operation of the motor so as to cause selective rotation and/or reciprocation of the drill pipe (12) which causes movement of the logging tool (27), when fixed to the drill pipe (12), in a manner that is detectable by the movement sensor (33).

48 Claims, 1 Drawing Sheet

(56) References Cited

U.S. PATENT DOCUMENTS

| | | | | |
|---|---|---|---|---|
| 2007/0280048 | A1 | 12/2007 | Dubinsky | |
| 2008/0000688 | A1 | 1/2008 | McLoughlin et al. | |
| 2009/0200084 | A1* | 8/2009 | Vuyk, Jr. ..... | E21B 7/18 175/67 |
| 2013/0092439 | A1 | 4/2013 | Mauldin et al. | |
| 2015/0107903 | A1 | 4/2015 | Sugiura | |
| 2015/0130627 | A1 | 5/2015 | Morrison | |
| 2015/0226050 | A1 | 8/2015 | Bartel et al. | |

* cited by examiner

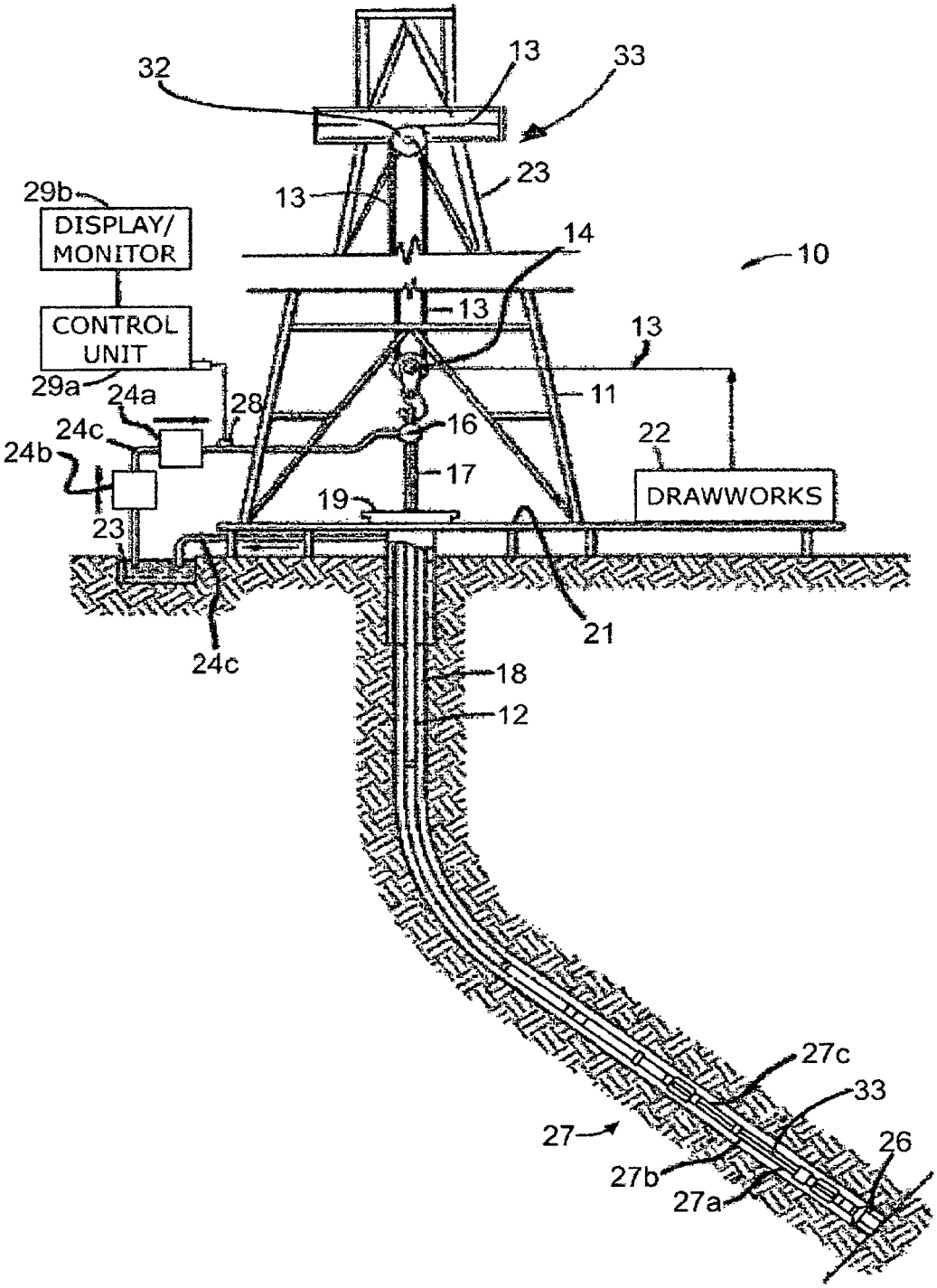
32
13
33
23
29b
DISPLAY/
MONITOR
13
14
10
CONTROL
UNIT
13
13
29a
24a
28
11
24c
16
22
24b
17
DRAWWORKS
19
23
21
24c
18
12
27c
33
27
26
27b
27a

COMMUNICATION METHODS AND APPARATUSES FOR DOWNHOLE LOGGING TOOLS

CROSS-REFERENCE TO RELATED APPLICATION

This application claims the benefit under 35 USC § 119(a) to UK Appl. GB 1500274.4, filed 8 Jan. 2015.

FIELD OF THE DISCLOSURE

The invention relates to communication methods and related apparatuses for downhole logging tools.

BACKGROUND OF THE DISCLOSURE

As is well known, prospecting for minerals of commercial or other value (including but not limited to hydrocarbons in liquid or gaseous form; water e.g. in aquifers; and various solids used e.g. as fuels, ores or in manufacturing) is economically an extremely important activity. Those wishing to extract such minerals from below the surface of the ground or the floor of an ocean need to acquire as much information as possible about both the potential commercial worth of the minerals in a geological formation and also any difficulties that may arise in the extraction of the minerals to surface locations at which they may be used.

For this reason, over many decades techniques of logging of subterranean formations have developed for the purpose of establishing, with as much accuracy as possible, information as outlined above both before mineral extraction activities commence and also, increasingly frequently, while they are taking place.

Broadly stated, logging involves inserting a logging tool including a section sometimes called a "sonde" into a borehole or other feature penetrating a formation under investigation; and using the sonde to energize the material of the rock, etc., surrounding the borehole in some way. The sonde or another tool associated with it that is capable of detecting energy is intended then to receive emitted energy that has passed through the various components in the rock before being recorded by the logging tool.

Such passage of the energy alters its character. Knowledge of the attributes of the emitted energy and that detected after passage through the rock may reveal considerable information about the chemistry, concentration, quantity and a host of other characteristics of minerals in the vicinity of the borehole, as well as geological aspects that influence the ease with which the target mineral material may be extracted to a surface location.

Logging techniques are employed throughout mining industries, and also in particular in the oil and gas industries.

The borehole usually is several thousands of feet in length yet is narrow (being perhaps as narrow as 3 inches), although in practice such a borehole is almost never of uniform diameter along its length.

It is known to convey a logging tool to a downhole location inside drill pipe. As is well known, drill pipe is strong, hollow steel pipe formed in lengths (sometimes called "singles") that are threaded at each end so that they can be joined to one another by screwing them together. Lengths of drill pipe that are thus connected together at a surface location are deployed sequentially into a borehole e.g. as drilling of the borehole takes place. This activity is sometimes referred to as "running in".

Typically, a drill head including plural rotary drill bits is secured on the free end of the most downhole length of drill pipe and may be caused to rotate and in some cases is additionally powered by fluid pumped in a downhole direction via the interior of the drill pipe in order to cut the material ahead of the downhole end of the drill pipe. Such fluid is circulated within the borehole and, after passing through the drill head, flows externally of the drill pipe to return to a surface location for filtering and re-use, carrying the debris of the drilling operation with it out of the borehole.

It is known to cause rotation of the drill pipe, and hence of an attached drill bit, through operation of the rotary table or top drive (both of which terms are known to a person of skill in the art) of a derrick that supports and guides the drill pipe at the surface location.

It is also known to cause longitudinal reciprocation of the drill pipe. Typically this is achieved through the use of a form of top drive or other drill string drive/support that includes an elevator. The elevator in a typical installation is capable of powering the drill pipe to move up and down in the borehole by a distance of several meters.

Appropriate control and/or programmed elements can be employed to cause rotation and/or reciprocation (when the aforthaid kind of top drive is fitted) of drill pipe in a borehole. At their simplest such elements include potentiometers or similar devices that can be used to control the activation of the rotary drive, top drive or elevator. More sophisticated control elements, including designs that are programmable, are also possible.

Several techniques exist for conveying logging tools of various types (such as acoustic, nuclear, gamma and resistivity tools as are known in the relevant art) for use at the downhole end of a length of drill pipe inserted into a borehole. Such techniques include shuttling the logging tool (i.e. keeping it inside the drill pipe within a protective shuttle, from which the logging tool is caused to protrude once it is in the correct location); so-called "garaging", as defined in patent no GB 2372057 A, in which the lowermost length of drill pipe acts in a similar manner to a shuttle and from which the logging tool is caused to protrude once the drill pipe has reached a desired depth in the borehole; and wireline drop-off deployment.

In the last-mentioned conveyance technique, a logging tool having a memory function is conveyed down-hole by wireline through the drill pipe and once deployed, projects into the openhole supported on a no-go at the bottom of the drill pipe.

When the drill pipe has reached total depth (the planned end of the well measured by the length of pipe required to reach the bottom) and then drawn back to allow a deployment space, a wireline drop off tool including one or more sondes is lowered into the drill pipe.

The sonde section(s) is/are detachable from the remainder of the drop-off tool, under certain controlled conditions. Typically there is a landing ring in the internal wall of the drill pipe, located near the mouth of the final (i.e. most downhole) piece of drill pipe, which receives a landing collar located on and protruding outwardly from the tool. The engagement ("landing") of the landing ring and collar secures the tool and pipe rigidly one to another. When this engagement has occurred, the sonde part and the remainder of the drop-off tool are detached from one another and the drop-off tool is removed from the well via the wireline. This leaves the sonde section(s) in place to carry out logging activities.

The result of this sequence is that part of the logging tool protrudes beyond the end of the drill pipe and therefore is exposed in a way that permits logging of the formation. A further part of the logging tool remains inside the drill pipe and defines the described landing collar connection to the drill pipe. Logging may then take place while pulling drill pipe from the well (i.e., removal of the drill pipe out of the borehole), with the memory of the logging tool recording log data without any need for wireline communication with a surface location. Following completion of the logging activity the logging tool is retrieved from the drill pipe and the recorded data downloaded for processing and analysis.

A characteristic of all the conveyance techniques outlined above is that before logging commences the logging tool must become landed on the end of the drill pipe, partially protruding as described in relation to the wireline drop-off deployment technique, such that the drill pipe rigidly supports the lugging tool.

To this end, it is desirable, and often essential, for communication between the surface location (where control, processing and command apparatuses are located) and the downhole logging tool to occur. Permanently in the case of the shuttling and garaging deployment methods, and once the wireline has been withdrawn in the wireline deployment method, there exists no direct connection (aside from the drill pipe itself) between the surface location and the logging tool.

As mentioned, during use a fluid that typically is a drilling mud or a combination of drilling mud and other fluids is often circulated through the drill pipe and the annulus surrounding it. It is known in the art to effect hydraulic communication between the surface and a logging tool using coded pulses generated in the drilling mud. Such pulses when used for downlink communication propagate in a downhole direction inside the drill pipe and are detected by pressure-sensing parts of the logging tool and/or the drill head. These latter then cause e.g. movement of the logging tool from a retracted position inside drill pipe to a protruding position, the extension of landing components that secure the logging tool to drill pipe, or the extension of parts that cause withdrawal of the drill head to a position permitting passage of part of the logging tool. The received pressure pulses also can initiate electronic commands e.g. causing the logging tool to become active and commence logging of the borehole.

The logging tool can also send a pressure pulse uplink signal, for instance through the closing of an otherwise open fluid flow path on correct landing of the tool on the drill pipe.

Pressure pulse signaling however is associated with numerous disadvantages. One of these concerns the great uncertainty of pressure pulse propagation time in the drill pipe fluid. The time taken for the pulse to reach the logging tool can be highly variable depending on a number of factors that are known to the person of skill in the art. This in turn can cause logging engineers to wait a considerable time for an uplink signal to arrive back at the surface location, before concluding e.g. that the downlink communication was unsuccessful and requires repeating. Since rig time is very expensive, time wasted in this fashion is strongly undesirable.

Moreover, at least the downlink signaling is hard to achieve reliably. This often results from the fact that the pressure pulse signal is generated by modulating the operational speed of the pump installed at the surface location for the purpose of circulating the fluid in the borehole. There may be significant latency and imprecision in the response of the pump to speed change commands; and more prosaically a drilling engineer responsible for controlling the pump may not correctly interpret the requests of a logging engineer as to the pressure pulse waveform, amplitude or frequency required.

SUMMARY OF THE DISCLOSURE

The invention, which is suitable for use with all logging tool types and virtually all drilling mud specifications, may be employed regardless of the tool conveyance method adopted. The invention seeks to alleviate one or more drawbacks of the prior art. The invention is of benefit in logging activities potentially in all kinds of mining, including the logging of reserves of water, oil or gas. The invention is of relevance regardless of the motor and control element type employed.

According to the invention in a first aspect, there is provided a communication method for a downhole logging tool that (a) is fixed to drill pipe in a well or borehole and (b) includes a logging tool movement sensor, the drill pipe being connected at a location remote from the downhole logging tool to one or more motors that are capable of controlledly rotating and/or longitudinally reciprocating the drill pipe in the well or borehole, the method including the steps of (i) causing rotation and/or longitudinal reciprocation of the drill pipe under the influence of the motor; (ii) using the logging tool movement sensor to detect rotation and/or longitudinal reciprocation of the downhole logging tool, caused by rotation and/or longitudinal reciprocation of the drill pipe, and (iii) generating a signal of the logging tool movement sensor that is indicative of rotation and/or longitudinal reciprocation of the downhole logging tool.

In this regard, garaging in a fixed position and landing of a logging tool at the downhole end of drill pipe typically give rise to a non-rotatable, longitudinally fixed connection between the drill pipe and the logging tools. The invention advantageously takes advantage of this effect in transferring rotation and/or reciprocation of the drill pipe to the logging tool.

The invention embraces within its scope communication effected solely by rotation of the drill pipe; communication effected solely by longitudinal reciprocation of the drill pipe, or communication effected by one or more combinations of rotary and reciprocal movement of the drill pipe.

Downlink signaling in accordance with the invention is more reliable than the use of mud pulses, and moreover is associated with much quicker uplink feedback or confirmation signaling than the prior art. This is not least because rotation and/or reciprocation of drill pipe at a surface location, which reliably becomes rotation and/or reciprocation of the drill pipe downhole, may be visually verified at surface level in addition to being verified in other ways.

In preferred embodiments of the invention, the logging tool movement sensor is an angular rate sensor that detects rotation of the logging tool and generates one or more signals indicative of such rotation. Additionally or alternatively the logging tool movement sensor is an accelerometer or other device that detects longitudinal movement of the logging tool and generates one or more signals indicative of such movement.

Preferably, the method includes the further step of (iv)(a) causing the signal of the angular rate sensor to command a control action of the logging tool. Additionally or alternatively, the method includes the step of (iv)(b) causing the signal of the accelerometer to command a control action of the logging tool.

Such a control action advantageously could be, or include, for example completion of a logging tool landing or drop-off step; deployment of a member of or associated with the logging tool, the drill pipe or e.g. a landing collar of the drill pipe; opening or closing of a flow path through or around the logging tool in order to generate one or more local and/or uplink pressure pulse signals; and/or initiation, adjustment or termination of a logging window or session. In a presently particularly preferred embodiment of the invention, the control action is or includes causing deployment of the downhole logging tool from a non-deployed to a deployed configuration. Thus, the control action may include for example the key deployment steps of a shuttling, garaging or wireline drop-off conveyance/deployment method, and in particular the steps of such a method that take place once the logging tool has been conveyed to a downhole location at or near the place where logging is intended to commence.

As an alternative to commanding a control action, the method of the invention may beneficially be used to obtain information about the operational status of the downhole logging tool.

To this end, therefore, the method of the invention optionally may include the further step of ((v)(c) causing the signal of the angular rate sensor to cause transmission of a further signal from the downhole logging tool to a remote location, that is indicative of the status of the downhole logging tool.

Additionally or alternatively, the method of the invention optionally may include the further step of (iv)(d) causing the signal of the accelerometer to cause transmission of a further signal, from the downhole logging tool to a remote location, that is indicative of the status of the downhole logging tool.

Conveniently, the logging tool is rigidly fixed to the drill pipe at the time the method steps of the invention are carried out. In the majority of practical embodiments of the invention, this is likely to be the case; but it is possible to envisage embodiments of the invention in which the downlink signaling is effected using longitudinal reciprocation of the drill pipe, and in which the logging tool is fixed only with respect to longitudinal movement relative to the drill pipe.

Similarly, it is possible for the logging tool to be fixed with regard to rotation relative to the drill pipe, and to be longitudinally moveable. Also, it is possible to devise embodiments of the invention in which e.g. damped or amplitude-limited movement of the logging tool relative to the drill pipe is possible. Such arrangements lie within the scope of the claims hereof.

Regardless of the exact fixing mode of the logging tool in its operative (downhole) location, in general terms commanding of a control action of the logging tool causes alteration of the status, operation or configuration of the downhole logging tool.

Further, preferably the step of detecting rotation of the downhole logging tool includes the step of (iia) assessing whether the average rate of rotation of the downhole logging tool in one or more predetermined time periods exceeds a predetermined threshold.

This feature of the method of the invention accommodates a phenomenon known as "stick-slip", in which, as a result of friction and other forces acting on the drill pipe downhole, rotation of drill pipe at the surface location is not converted smoothly or continuously to rotation at the downhole location. The detection of an average rotational speed over a predetermined time window allows temporary slowing or halting of the drill pipe rotation to be disregarded in assessments of whether a rotational signal has been intentionally transmitted.

Additionally, preferably the step of detecting rotation of the downhole tool includes the step of (iib) assessing whether the average rate of rotation of the downhole logging tool in one or more predetermined time periods is less than a predetermined threshold.

This optional feature of the method of the invention avoids communication errors that might otherwise arise if the drill pipe is rotated at speeds approaching the (relatively high) rotational speeds that can be used during drilling operations. Additionally it helps to avoid damage to the tools in their downhole locations.

Additionally or alternatively to the foregoing, the step of detecting rotation of the downhole logging tool includes the step of (iic) assessing whether any rotation of the downhole tool occurs in one or more predetermined time periods. Thus it is possible to signal in a downlink direction to the logging tool using the method of the invention by allowing the interpretation of rotation in time windows when no drilling-related rotation of the drill pipe is expected.

Furthermore, it is possible to employ a simple binary gate device (such as but not limited to an Op Amp) in the logging tool for the purpose of detecting signals transmitted in accordance with the invention.

The Step (iic) may be used in combination with optional Steps (iia) and/or (iib).

In one preferred method of the invention, the step of detecting longitudinal reciprocation of the downhole logging tool includes the step of (ii)(d) assessing whether axial movement of the downhole tool occurs in one or more predetermined time periods. In another embodiment, the step of detecting longitudinal reciprocation of the downhole logging tool includes the step of (ii)(e) assessing whether a predetermined sequence of axial movements of the downhole tool occurs in one or more programmable time gates. In yet another embodiment, the step of detecting longitudinal reciprocation of the downhole logging tool includes the step of (ii)(f) assessing the extent of movement of the drill pipe out of the hole, or detecting in one or more predetermined time gates a predetermined sequence of axial or rotational movements of the downhole tool.

The method of the invention may be used in combination with other downlink signaling methods, including one or more prior art methods as described herein. In particular the method of the invention may include the further step of (v) inducing one or more pressure pulses in fluid in the vicinity of the downhole logging tool; and using the combination of one or more said pressure pulses and commanding of a control action in Step (iv) to effect a command action in the downhole logging tool.

Preferably, the Step (v) includes operating or causing operation of a pump to induce uric or more said pressure pulses. Typically, such a pump is the borehole circulation pump at the surface location.

In preferred embodiments of the invention, the downhole logging tool is capable of altering the rate of flow of fluid in its vicinity; and a said control action includes causing the downhole logging tool to reduce the rate of flow of fluid in its vicinity to generate a pressure pulse, that is detectable at a location remote from the downhole logging tool, to signify commanding of a control action at the downhole logging tool.

More specifically, the downhole logging tool includes a fluid flow path having an adjustable flow restriction; and the method includes the step of (vi) causing the flow restriction to reduce the flow of fluid in the vicinity of the downhole logging tool. Examples of such an arrangement are known to the person of skill in the art.

It is preferable that the motor is at or near a surface location, as is conventional in drilling operations. In particular the motor may be selected from the list including a rotary drive, a top drive or a drill string drive including a drill pipe elevator.

In a second aspect of the invention, there is provided logging tool communication apparatus, for performing a method in accordance with the first aspect of the invention, comprising rotatable and/or longitudinally reciprocable drill pipe including fixed or capable of being fixed in a co-rotative and/or co-reciprocable relationship at an in-use downhole end a downhole logging tool, the logging tool including a movement sensor and the apparatus including a motor, at a location remote from the logging tool, for causing rotation and/or reciprocation of the drill pipe in a borehole or wellbore; and one or more control elements for selectively controlling operation of the motor so as to cause selective rotation and/or reciprocation of the drill pipe, rotation and/or reciprocation of the drill pipe causing movement of the logging tool, when fixed to the drill pipe, in a manner that is detectable by the movement sensor.

Such apparatus is particularly suited for carrying out the steps of the method of the invention.

Preferably, the logging tool movement sensor is an angular rate sensor that detects rotation of the logging tool and generates one or more signals indicative of such rotation.

Additionally or alternatively, the logging tool movement sensor is an accelerometer that detects longitudinal movement of the logging tool and generates one or more signals indicative of such movement.

Optionally, interpretation of the angular rate sensor is capable of generating a signal that commands a control action of the logging tool; and further optionally interpretation of the accelerometer is capable of generating a signal that commands a control action of the logging tool.

Additionally or alternatively, the angular rate sensor is capable of generating a signal that causes generation of a further signal that is transmissible remotely from the downhole logging tool and is indicative of the status of the downhole logging tool. Similarly the accelerometer when present is capable of causing generation of such a further signal that is transmissible remotely from the downhole logging tool.

Thus, the apparatus of the invention is suitable for the performance of a method as defined herein that involves the use of reciprocation and/or rotation of drill pipe connected to the downhole logging tool as a method of interrogating the logging tool as to its status. The latter may in response signal its status through the generation of a transmissible signal such as but not limited to a mud pressure pulse.

Preferably, the one or more control elements is or includes a potentiometer connected to control operation of the motor to control rotation of the drill pipe. Additionally or alternatively, the one or more control elements is or includes a programmable device.

In preferred embodiments of the invention, the logging tool includes a fluid flow path having an adjustable flow restriction that in use is operable to reduce the flow of fluid in the vicinity of the logging tool on generation of a said command of a control action at the logging tool.

It is also preferable that the logging tool includes one or more processors for processing one or more signals of the movement sensor and generating therefrom one or more commands of control actions.

Optionally, the motor may be constituted as or include a rotary table of a drilling rig; a top drive of a drilling rig; and/or a drill string drive of a drilling rig including a drill pipe elevator.

Preferred, convenient and optional features of the apparatus of the second aspect of the invention are associated with analogous advantages to the counterpart features of the method of the first aspect of the invention, and for this reason are not repeated.

According to a third aspect of the invention, there is provided a kit of parts comprising two or more lengths of drillpipe that are releasably securable one to another for insertion into a borehole or wellbore so as to be rotatable and/or longitudinally reciprocable therein; and, fixed or capable of being fixed in a co-rotative and/or co-reciprocable relationship at an in-use downhole end of a said length of drill pipe a logging tool having a movement sensor that is capable of generating a signal in response to detection of rotation and/or longitudinal reciprocation of the logging tool.

Such a kit may readily be assembled to form apparatus in accordance with the second aspect of the invention and following assembly may be used to carry out a method in accordance with the first aspect of the invention.

The kit preferably includes a motor, at an in-use location that is remote from the logging tool, for causing rotation and/or longitudinal reciprocation of the drill pipe in a borehole or wellbore; and one or more control elements for selectively controlling operation of the motor.

As in the case of the logging apparatus of the second aspect of the invention, the motor of the kit may be constituted as or include a rotary table of a drilling rig, a top drive or a drill string drive of a drilling rig including a drill pipe elevator.

It is also preferable that the logging tool includes a fluid flow path having an adjustable flow restriction that in use is operable to reduce the flow of fluid in the vicinity of the logging tool. Optionally the logging tool may include one or more processors for processing one or more signals of the movement sensor and generating therefrom one or more commands of control actions.

Preferred, convenient and optional features of the kit of the third aspect of the invention are associated with analogous advantages to the counterpart features of the method of the first aspect of the invention and the apparatus of the second aspect of the invention, and for this reason are not repeated.

The invention is considered further to reside in log data acquired using (a) a method according to the first aspect of the invention, (b) apparatus according to the second aspect of the invention or (c) a kit according to the third aspect of the invention.

BRIEF DESCRIPTION OF THE DRAWINGS

FIGURE is a schematic representation of one form of drilling rig apparatus that is suitable for putting into effect the various aspects of the invention.

DETAILED DESCRIPTION

There now follows a description of preferred embodiments of the invention, by way of non-limiting example, with reference being made to the accompanying drawing which is a schematic representation of one form of drilling rig apparatus that is suitable for putting into effect the various aspects of the invention.

Referring to the drawings, the FIGURE shows in a truncated, schematic, non-limiting form a drilling activity. In the FIGURE, a land-based drilling rig 10 includes a derrick 11 of a per se known kind supporting a drill string chiefly composed of lengths of drill pipe 12 by way of a drill line 13 acting via a travelling block 14, swivel 16 and kelly drive 17 all of which may be of conventional designs.

The drill string extends along a borehole 18 for a distance that may be several hundred or thousand meters.

The kelly drive 17 acts via a rotary table 19 set in a drill floor 21 that also supports a motor, drill line drum and ancillary parts 22 referred to sometimes as draw works.

Drilling mud is circulated as indicated by arrows from a mud pit 23 between the drill string 12 and borehole 18 by way of per se known pump 24*a*, filter 24*b* and pipework 24*c* components. The pipework connects to the borehole via schematically shown unions at the swivel 16 and rotary table 19, also in a per se known manner.

At its downhole end inside the borehole, the drill string terminates in one or more drill bits or cutters 26. These may adopt a range of designs including but not limited to the exemplary one illustrated. Rotary drive in use of the drilling rig 10 is transferred from e.g. the motor of the draw works 22 via a chain or shaft drive to the rotary table 19 that by way of keyed engagement with the kelly drive 17 effects rotation of the drill string 12. This, in turn, causes cutting of rock at the downhole end of the borehole 18. Cuttings resulting from this action are conveyed in the circulating drilling mud to the mud pit 23, where they settle for later recovery or treatment. The filter 24*b* prevents thus removed cuttings from being conveyed to the drill bit 26 unless an injection of cuttings is required (in which case the filter 24*b* may be temporarily bypassed or disconnected from the pipework 24*c*).

At its uppermost end, derrick 11 includes a top drive 31 the features of which are known in the art. The simple top drive illustrated has as its primary purpose the reciprocal paying-out and winding in of drill line 13 in order to accommodate movement of the drill string as it advances during a logging operation.

In this regard, as the drill string advances in a downhole direction, the drill pipe 12 becomes inserted progressively further and further into the borehole 18. This causes the swivel repeatedly to approach the rotary table 19, with the drill line 13 extending under the control of the top drive 31 which includes a pulley 32 fed with drill line from a drum that is omitted from the FIGURE for clarity.

Each time the swivel 16 reaches a limit of proximity to the rotary table, it is disconnected from the drill pipe 12 forming the major part of the drill string and raised under the action of the top drive 31 which includes a (not illustrated) drill line winding motor for this purpose. This provides space between the uppermost end of the drill string 12 and the underneath of the swivel for screwing in of a fresh stand of drill pipe, thereby lengthening the drill string overall.

The upper end of the thus-added drill pipe is connected to the swivel 16 and hence to the pipework 24*c* via which as noted drilling mud is pumped in a downhole direction for use at the drill bit 26 and subsequent circulation back to the mud pit 23.

By repeating the foregoing steps, lengthening of the drill string to take account of advancing of the drill bit 26 is effected, typically until a chosen depth of borehole has been drilled. During this process in the embodiment shown, the rotary table causes rotation of the drill string in order to give rise to a drilling action at the drill bit, and the top drive by lengthening and shortening the drill line 13 takes account of the need to accommodate longitudinal (up and down) reciprocation of the drill string as drilling takes place.

Other types of drill bit and top drive however are also possible. Thus, it is known for instance to provide a drill bit that instead of being caused to rotate by rotation of the drill string is hydraulically powered to rotate by the drilling mud acting on the drill bit parts as it is pumped through the well. In yet further embodiments drill bit designs are possible in which a combination of drill string rotation and hydraulic actuation are used.

Similarly, a more sophisticated top drive than that shown may also be provided that causes rotation of the drill string from the top of the derrick instead of under the influence of the motor that drives the rotary table 19.

A further variant that is known in the art is a top drive that includes an elevator mechanism for lifting and lowering heavy drill strings or drill strings that have become stuck or difficult to move because of friction at a downhole location. Yet, a further variant is a drill string elevator that is provided at a location other than the top drive, such as on or suspended from a (not illustrated) monkey board between the top drive and the rotary table. All such variants-are within the scope of the invention.

Between the drill bit 26 and the remainder of the drill pipe 12, a plurality of logging sondes or subs 27*a-c* are connected in an in-line fashion.

In the non-limiting embodiment shown in the FIGURE, three subs 27*a*, 27*b*, 27*c* are illustrated that may be respectively a transmitter 27*a*, a receiver 27*b* and an electronics sub 27*c*. Numerous other arrangements of logging tool 27 are possible within the scope of the invention, which is not limited to any particular logging tool type or design.

As is well known in the well logging art, the transmitter 27*a* of the logging tool 27 in use energizes the rock in the vicinity of the drill bit 26. The receiver 27*b* receives energy that has been altered in some way by the formation; and the electronics sub 27*c* may contain an electronics section that conditions electrical signals generated by the receiver sonde 27*b* for transmission to or, increasingly commonly, downloading at a surface location.

As explained above, for various reasons it is frequently not possible to provide wired communication between the control and processing equipment 29*a* and display equipment 29*b* connected via connection 28 to pipework 24*c* and typically installed at the surface location and the downhole sondes 27*a-c*. In such a case, the immediate transmission of data from downhole to the surface is not possible (or can only be achieved sub-optimally, using the prior art signaling techniques described herein); and instead it is necessary for the logging tool 27 to store log data during the logging process, which proceeds as described herein once the sondes 27*a-c* are in the correct part of the borehole.

Initiating of such recording logging activities requires downlink signaling to the sondes 27*a-c*, and uplink feedback signaling to provide confirmation as quickly as possible that the downlink signaling has had the intended effect. The essence of the invention is to provide one or more movement sensors in the sondes 27*a-c*, and use these to detect distinctive movements intentionally induced in the drill pipe. The drill pipe movements are characteristic of downlink signals and are distinguishable from other movements that might arise during conventional operation of the drilling equipment.

One such movement sensor is indicated schematically by reference numeral 33 in FIGURE. Plural movement sensors may be provided, in more than one logging sub 27*a*, 27*b*, 27*c* (if plural subs are present as part of the downhole assembly). Equally the invention may readily be embodied using only a single movement sensor 33 as illustrated.

The movement sensor(s) 33 may detect rotation or longitudinal acceleration of the logging tool 27 landed at the end of the drill pipe 12. Thus the sensor(s) may be angular rate sensors, accelerometers or other, similar devices. Sensors (or combinations of sensors) that combine such detection functions are also possible within the scope of the invention.

One preferred mode of use of the apparatus of the invention involves running in the drill pipe 12 until a desired depth is achieved. This process typically involves forming the borehole 18 using the drill bit 26 secured at the downhole end of the drill string. In some embodiments of the invention and some modes of use the borehole 18 could be pre-existing, the requirement being to log a borehole that has been formed in a separate drilling operation. In such a case the drill bit 26 may be absent from the drill string.

Regardless of the exact mode of forming the borehole 18, once the end of the drill pipe extends to the chosen depth in cases in which there is no wireline connection to the surface, it is necessary to command deployment and/or activation of the logging tool 27.

In accordance with one mode of the invention, in which one or more subs 27*a*, 27*b*, 27*c* includes an angular rate sensor, such commanding is effected by causing rotation of the drill pipe at the surface location, and detecting such rotation at the logging tool 27 once the latter is landed at the end of the drill pipe in a way that necessitates co-rotation of the drill pipe 12 and logging tool 27.

Either the rotary table 19 or if it is of a suitable kind the top drive 31 may, at the option of e.g. the system designer or a drilling engineer, be used for causing such rotation.

As is well known, the rotary table 19 is also used to cause downhole drill pipe rotation during drilling operations. It would be undesirable for such drilling-related rotation of the drill pipe mistakenly to be detected by the logging tool 27 as a deployment or activation command. For this reason, the chosen rate of rotation of the drill pipe 12 is clearly distinct from that used when drilling rotations are required. Thus, for example, the rotational speed used when commanding deployment of the logging tool 27 may lie in the range 0 to 60 rpm, which is significantly less than the typical drilling rotational speed of 100-500 rpm.

The logging tool 27 may to this end include one or more processors such as Op Amps or other binary gate devices that are programmed to identify the aforementioned distinction between rotational speeds of the drill pipe 12 and thereby avoid activation of the logging tool 27 when this is inappropriate or not required. The use of Op Amps beneficially assures the simplicity of processing hardware associated with the invention. Other types of processing device however are possible within the scope of the invention.

A phenomenon that is known in relation to causing movement of drill pipe is that of so-called "stick-slip", in which continuous movement of the drill pipe 12 induced at the surface location as a result of friction and other effects becomes intermittent or jerky movement at the downhole location. In order to overcome the potential disadvantage that such intermittent movement may represent, a refinement of the invention involves programming the logging tool 27 to detect an average rotational speed during a time window, and using this to determine whether a meaningful command has been transmitted.

In such an arrangement and mode of operation, the detected average rotational speed of a valid downlink command may be e.g. greater than a rotational speed threshold, less than a rotational speed threshold, or be within the bounds of a speed threshold range.

As an alternative to average speed determination, another mode of operation may involve simply detecting whether any rotation has occurred at all in a predetermined time period. Thus, for instance, the processor of the logging tool 27 may initiate a timer when landing of the tool 27 occurs. If any rotational movement or sequence of rotational movements at all of the logging tool 27 on the drill pipe is detected within a chosen time after the landing step, this can be taken as a downlink command to deploy the logging tool 27 and/or commence logging activity.

In addition to or as an alternative to downlink signaling as described above, using the detection of logging tool rotation if (a) the logging tool 27 includes a longitudinally operative accelerometer and (b) the derrick 11 includes one or more forms of drill pipe elevator, it is possible to use longitudinal reciprocation of the drill pipe 12 as a downlink command signal.

Thus, in like manner to the arrangements described above, the logging tool 27 may be programmed to identify distinctive longitudinal movements of the landed logging tool 27 as command signals. One example of many possible signal patterns in this regard could be e.g. a sequence of up-and-down reciprocations in a certain period after landing of the tool 27 or after arrival of the tool 27 at its most downhole location.

In some embodiments of the invention, combinations of rotational and reciprocatory movements are possible. In such cases, the logging tool 27 would need to include sensors of both types of movement, and be programmed correctly to interpret the resulting combinations of movements.

Regardless of the chosen manner in which the downlink signal is propagated once it has been correctly interpreted at the logging tool 27, the latter typically then would respond e.g. by initiating deployment into the openhole section of the borehole 18 beyond the drill pipe 12; by altering the status of the drill bit or some other apparatus located close enough to the logging tool 27 that the tool 27 may influence it e.g. through extension of an extensible member, generation of an electric or magnetic field, electronically or through generation of a fluid pulse; or by commencing logging activity. The precise response of the logging tool 27 in this regard will depend on the downhole equipment present and the manner in which it is intended to be used.

Following such action, the logging tool 27 may in accordance with the invention generate an uplink feedback signal for the purpose of indicating to surface equipment and personnel the completion or at least the initiation of the activity commanded by the downlink signal.

One way of effecting the uplink feedback signaling is through the generation of a simply coded pulse in drilling mud (or another fluid) with which the borehole is circulated using the pump 24*a*. To this end, the logging tool 27 may include a fluid flow path that is normally open in order to permit the flow of fluid form the uphole side of the logging tool 27 to the downhole side and eventually out of the end of the drill pipe 12. This fluid flow path may include one or more valves that are arranged to close off the flow of fluid in the event of correct receipt of a downlink signal as aforesaid. Closing of the valve in this way in turn causes a change in the circulated fluid pressure, i.e. a pressure pulse, stop function or other simple waveform.

The amplitude of the pulse or step function etc. can be sufficient to cause propagation of the pulse, step function, etc. in the borehole fluid along the length of the borehole 18.

As a result, the generated pressure waveform is detectable at the surface location as an indication of correct downlink signaling and a consequent logging tool response. The valve may be arranged in this optional aspect of the invention partially and/or temporarily to close off the fluid flow path, such that circulation of the well is not completely halted and such that a distinct waveform can be generated.

Another option within the scope of the invention is to employ rotation and/or reciprocation of the logging tool 27 landed on the drill pipe in combination with mud pulse generation. Thus, a possibility is for a rotational or reciprocal drill pipe movement to initiate generation by the logging tool 27 of a mud pressure pulse that in turn effects a control action in another item of downhole equipment present in the vicinity of the logging tool 27.

As noted herein the apparatus, kit and method of the invention may be useful when it is required to interrogate the logging tool 27 as to its operational status.

Thus, rotation and/or reciprocation of the drill pipe 12 may be used to provoke a status response from the downhole logging tool 27. A particular sequence, pattern or speed of the drill pipe movement may be used to signify a status interrogation as opposed to a control action command.

The movement sensor(s) 33 (e.g., the angular rate sensor or accelerometer) may in such circumstances generate a signal that in turn causes the creation of a further transmissible status signal. The further, transmissible signal may be in the form of a mud or other borehole fluid pulse that is generated as exemplified in the foregoing paragraphs.

In practice, an operator may cause the drill pipe movement to result in interrogation of the logging tool status. The operator then may wait a predetermined time for propagation of the borehole fluid pulse to be detectable at a surface location. If the pulse is detected within the predetermined time the operator may conclude that the logging tool 27 is in an operational status. If the pulse is not detected in a timely fashion or a fluid pulse indicating a failure is received the operator may conclude that the logging tool 27 is not operational.

The operator may in the case of an undue delay or of receipt of a signal failure pulse initiate such remedial steps as are required. These may include the sending of further commands to the logging tool 27, the dispatch of further tools such as drop balls, darts or various logging tool retrieval devices to the downhole location of the logging tool 27; or the removal of drill pipe stands in order to bring the logging tool 27 to the surface e.g. for repair. The method and apparatus of the invention allow decisions on whether to initiate steps such as the foregoing to be made in less time than is required for prior art methods.

For the avoidance of doubt, the invention resides in both apparatus, as exemplified by the FIGURE apparatus, for signaling as described herein; and also in methods as described herein.

In this regard, the FIGURE includes various optional components that are not essential for implementing a simple version of the invention, which moreover resides in a kit of parts from which apparatus (whether more or less complex than that shown in the FIGURE) for putting the invention into effect may be assembled.

Also, for the avoidance of doubt, the scope of the invention extends to combinations of rotational and/or reciprocal movements of the drill pipe that respectively give rise to control actions and status interrogation steps.

The invention furthermore resides in log data acquired using the method and/or the apparatus defined herein.

Overall the method, apparatus and kit of the invention provide a robust, reliable means of generating and detecting downlink communications. In particular, the rotational and reciprocal movements of the drill pipe described herein may readily be generated using drill pipe control equipment that typically is encountered on derricks and in other drilling machinery. Moreover, the rotational and reciprocal signals that are effective in the method of the invention typically are simple. Therefore, they do not require the development of a complex coding language, and they can easily be created by drilling engineers based on easily conveyed instructions and requests from logging engineers having responsibility for operation of the logging tools 27. The rotational and reciprocal signals do not suffer from the latency and imprecision of downlink signals generated as borehole fluid pulses using a circulation pump.

Preferences and options for a given aspect, feature or parameter of the invention should, unless the context indicates otherwise, be regarded as having been disclosed in combination with any and all preferences and options for all other aspects, features and parameters of the invention.

The listing or discussion of an apparently prior-published document in this specification should not necessarily be taken as an acknowledgement that the document is part of the state of the art or is common general knowledge.

What is claimed is:

1. A communication method for a downhole logging tool that (a) is configured to energize rock surrounding a well or borehole and receive emitted energy that has passed through the rock; (b) is fixed to a drill pipe in the well or borehole and (c) includes a logging tool movement sensor, the drill pipe being connected at a location remote from the downhole logging tool to one or more motors that are capable of controlledly rotating and/or longitudinally reciprocating the drill pipe in the well or borehole, the method including the steps of:

causing rotation and/or longitudinal reciprocation of the drill pipe under the influence of the motor;

detecting, using the logging tool movement sensor, rotation of the downhole logging tool caused by rotation of the drill pipe; and generating a first signal of the logging tool movement sensor that is indicative of rotation of the downhole logging tool, wherein the logging tool movement sensor comprises an angular rate sensor that detects rotation of the logging tool and generates the first signal indicative of such rotation;

wherein the step of detecting rotation of the downhole logging tool includes the step of assessing whether the average rate of rotation of the downhole logging tool in one or more predetermined time periods exceeds a predetermined threshold; and wherein the predetermined threshold is distinct from a drilling rate of rotation.

2. The method according to claim 1, including the further step of causing the first signal of the angular rate sensor to command a control action of the logging tool.

3. The method according to claim 2, wherein commanding of the control action of the logging tool causes alteration of the status, operation or configuration of the downhole logging tool.

4. The method according to claim 3, wherein alteration of the status, operation or configuration of the downhole logging tool is or includes causing deployment of the downhole logging tool from a non-deployed to a deployed configuration.

5. The method according to claim 1, including the further step of causing the first signal of the angular rate sensor to cause transmission of a further signal, from the downhole logging tool to a remote location, that is indicative of the status of the downhole logging tool.

6. The method according to claim 1, wherein the logging tool is rigidly fixed to the drill pipe.

7. The method according to claim 1, including the step of using a binary gate device that is operatively connected to the logging tool to determine whether generation of the first signal should occur.

8. The method according to claim 1, including the further step of inducing one or more pressure pulses in fluid in the vicinity of the downhole logging tool; commanding of a control action in the downhole logging tool; and using the combination of one or more said pressure pulses and commanding of the control action to effect a command action in the downhole logging tool.

9. The method according to claim 8, wherein the step of inducing includes operating or causing operation of a pump to induce one or more said pressure pulses.

10. The method according to claim 1, wherein the downhole logging tool is capable of altering the rate of flow of fluid in a vicinity of the downhole logging tool; and wherein the method includes causing the downhole logging tool to reduce the rate of flow of fluid in the vicinity to generate a pressure pulse, that is detectable at a location remote from the downhole logging tool, to signify commanding of a control action at the downhole logging tool.

11. The method according to claim 10, wherein the downhole logging tool includes a fluid flow path having an adjustable flow restriction; and wherein the method includes the step of causing the flow restriction to reduce the flow of fluid in the vicinity of the downhole logging tool.

12. The method according to claim 1, wherein the motor is at or near a surface location.

13. The method according to claim 1, wherein the motor is one or more selected from the list including a rotary drive, a top drive, a drill string drive including a drill pipe elevator or a drill string drive including a draw works.

14. The method of claim 1, further comprising:

detecting, using the logging tool movement sensor, longitudinal reciprocation of the downhole logging tool caused by longitudinal reciprocation of the drill pipe; and generating a second signal of the logging tool movement sensor that is indicative of longitudinal reciprocation of the downhole logging tool.

15. The method according to claim 14, wherein the logging tool movement sensor is an accelerometer that detects longitudinal movement of the logging tool and generates the second signal indicative of such movement.

16. The method according to claim 15, including the further step of causing the second signal of the accelerometer to command a control action of the logging tool.

17. The method according to claim 15, including the further step of causing the second signal of the accelerometer to cause transmission of a further signal, from the downhole logging tool to a remote location, that is indicative of the status of the downhole logging tool.

18. The method according to claim 14, wherein the step of detecting longitudinal reciprocation of the downhole logging tool includes the step of assessing whether axial movement of the downhole tool occurs in one or more predetermined time periods.

19. The method according to claim 14, wherein the step of detecting longitudinal reciprocation of the downhole logging tool includes the step of assessing whether a predetermined sequence of axial movements of the downhole logging tool occurs in one or more programmable time gates.

20. The method according to claim 14, wherein the step of detecting longitudinal reciprocation of the downhole logging tool includes the step of assessing the extent of movement of the drill pipe out of the hole, or detecting in one or more predetermined time gates a predetermined sequence of axial or rotational movements of the downhole logging tool occurs in one or more programmable time gates.

21. A communication method for a downhole logging tool that (a) is configured to energize rock surrounding a well or borehole and receive emitted energy that has passed through the rock; (b) is fixed to a drill pipe in the well or borehole and (c) includes a logging tool movement sensor, the drill pipe being connected at a location remote from the downhole logging tool to one or more motors that are capable of controlledly rotating and/or longitudinally reciprocating the drill pipe in the well or borehole, the method including the steps of:

causing rotation and/or longitudinal reciprocation of the drill pipe under the influence of the motor;

detecting, using the logging tool movement sensor, rotation of the downhole logging tool caused by rotation of the drill pipe, and generating a first signal of the logging tool movement sensor that is indicative of rotation of the downhole logging tool, wherein the logging tool movement sensor comprises an angular rate sensor that detects rotation of the logging tool and generates the first signal indicative of such rotation;

wherein the step of detecting rotation of the downhole logging tool includes the step of (ii)(a) assessing whether the average rate of rotation of the downhole logging tool in one or more predetermined time periods is less than a predetermined threshold; and wherein the predetermined threshold is distinct from a drilling rate of rotation.

22. The method of claim 21, further comprising:

detecting, using the logging tool movement sensor, longitudinal reciprocation of the downhole logging tool caused by longitudinal reciprocation of the drill pipe; and generating a second signal of the logging tool movement sensor that is indicative of longitudinal reciprocation of the downhole logging tool.

23. The method according to claim 22, wherein the logging tool movement sensor is an accelerometer that detects longitudinal movement of the logging tool and generates the second signal indicative of such movement.

24. The method according to claim 23, including the further step of (iv)(b) causing the second signal of the accelerometer to command a control action of the logging tool.

25. The method according to claim 23, including the further step of (iv)(d) causing the second signal of the accelerometer to cause transmission of a further signal, from the downhole logging tool to a remote location, that is indicative of the status of the downhole logging tool.

26. The method according to claim 22, wherein the step of detecting longitudinal reciprocation of the downhole logging tool includes the step of assessing whether axial movement of the downhole tool occurs in one or more predetermined time periods.

27. The method according to claim 22, wherein the step of detecting longitudinal reciprocation of the downhole logging tool includes the step of assessing whether a predetermined sequence of axial movements of the downhole logging tool occurs in one or more programmable time gates.

28. The method according to claim 22, wherein the step of detecting longitudinal reciprocation of the downhole logging tool includes the step of assessing the extent of movement of the drill pipe out of the hole, or detecting in one or more predetermined time gates a predetermined sequence of axial or rotational movements of the downhole logging tool occurs in one or more programmable time gates.

29. The method according to claim 21, including the further step of causing the first signal of the angular rate sensor to command a control action of the logging tool.

30. The method according to claim 29, wherein commanding of the control action of the logging tool causes alteration of the status, operation or configuration of the downhole logging tool.

31. The method according to claim 30, wherein alteration of the status, operation or configuration of the downhole logging tool is or includes causing deployment of the downhole logging tool from a non-deployed to a deployed configuration.

32. The method according to claim 21, including the further step of causing the first signal of the angular rate sensor to cause transmission of a further signal, from the downhole logging tool to a remote location, that is indicative of the status of the downhole logging tool.

33. The method according to claim 21, wherein the logging tool is rigidly fixed to the drill pipe.

34. The method according to claim 21, including the step of using a binary gate device that is operatively connected to the logging tool to determine whether generation of the first signal should occur.

35. The method according to claim 21, including the further step of inducing one or more pressure pulses in fluid in the vicinity of the downhole logging tool; commanding of a control action in the downhole logging tool; and using the combination of one or more said pressure pulses and commanding of the control action to effect a command action in the downhole logging tool.

36. The method according to claim 35, wherein the step of inducing includes operating or causing operation of a pump to induce one or more said pressure pulses.

37. The method according to claim 21, wherein the downhole logging tool is capable of altering the rate of flow of fluid in a vicinity of the downhole logging tool; and wherein the method includes causing the downhole logging tool to reduce the rate of flow of fluid in the vicinity to generate a pressure pulse, that is detectable at a location remote from the downhole logging tool, to signify commanding of a control action at the downhole logging tool.

38. The method according to claim 37, wherein the downhole logging tool includes a fluid flow path having an adjustable flow restriction; and wherein the method includes the step of causing the flow restriction to reduce the flow of fluid in the vicinity of the downhole logging tool.

39. The method according to claim 21, wherein the motor is at or near a surface location.

40. The method according to claim 21, wherein the motor is one or more selected from the list including a rotary drive, a top drive, a drill string drive including a drill pipe elevator or a drill string drive including a draw works.

41. Logging tool communication apparatus, for performing a method according to claim 1, comprising:

drill pipe being rotatable and/or longitudinally reciprocable;

an in-use downhole logging tool being fixed or capable of being fixed in a co-rotative and/or co-reciprocable relationship at an in-use downhole end of the drill pipe, the logging tool being configured to energize rock surrounding a borehole or wellbore and receiving emitted energy that has passed through the rock, the logging tool including a movement sensor;

a motor disposed at a location remote from the logging tool and being operable to cause rotation and/or reciprocation of the drill pipe in the borehole or wellbore; and one or more control elements in communication with the motor and selectively controlling operation of the motor so as to cause selective rotation and/or reciprocation of the drill pipe, the rotation and/or reciprocation of the drill pipe causing movement of the logging tool, when fixed to the drill pipe, the rotation being detectable by the movement sensor that generates a first signal indicative of the rotation, wherein the movement sensor comprises an angular rate sensor that detects rotation of the logging tool and generates the first signal indicative of such rotation;

wherein detection of the rotation by the movement sensor includes assessing whether the average rate of rotation of the downhole logging tool in one or more predetermined time periods exceeds a predetermined threshold; and wherein the predetermined threshold is distinct from a drilling rate of rotation.

42. The apparatus according to claim 41, wherein the one or more control elements is or includes a potentiometer connected to control operation of the motor to control rotation of the drill pipe.

43. The apparatus according to claim 1, wherein the one or more control elements is or includes a programmable device.

44. The apparatus according to claim 41, wherein the logging tool includes one or more processors for processing one or more signals of the movement sensor and generating therefrom one or more commands of control actions.

45. Logging tool communication apparatus, for performing a method according to claim 21, comprising:

drill pipe being rotatable and/or longitudinally reciprocable;

an in-use downhole logging tool being fixed or capable of being fixed in a co-rotative and/or co-reciprocable relationship at an in-use downhole end of the drill pipe, the logging tool being configured to energize rock surrounding a borehole or wellbore and receiving emitted energy that has passed through the rock, the logging tool including a movement sensor;

a motor disposed at a location remote from the logging tool and being operable to cause rotation and/or reciprocation of the drill pipe in the borehole or wellbore; and one or more control elements in communication with the motor and selectively controlling operation of the motor so as to cause selective rotation and/or reciprocation of the drill pipe, the rotation and/or reciprocation of the drill pipe causing movement of the logging tool, when fixed to the drill pipe, the rotation being detectable by the movement sensor that generates a first signal indicative of the rotation, wherein the movement sensor comprises an angular rate sensor that detects rotation of the logging tool and generates the first signal indicative of such rotation;

wherein detection of the rotation by the movement sensor includes assessing whether the average rate of rotation of the downhole logging tool in one or more predetermined time periods exceeds a predetermined threshold; and wherein the predetermined threshold is distinct from a drilling rate of rotation.

46. The apparatus according to claim 45, wherein the one or more control elements is or includes a potentiometer connected to control operation of the motor to control rotation of the drill pipe.

47. The apparatus according to claim 45, wherein the one or more control elements is or includes a programmable device.

48. The apparatus according to claim 45, wherein the logging tool includes one or more processors for processing one or more signals of the movement sensor and generating therefrom one or more commands of control actions.

* * * * *